United States Patent [19]

Young et al.

[11] Patent Number: 5,044,044

[45] **Date of Patent: * Sep. 3, 1991**

[54] HINGED STRUCTURE AND METHOD OF INTEGRATION IN A STANDARD SKI CONSTRUCTION

[75] Inventors: John L. Young, West Hollywood; David B. Burns, Santa Barbara; Joseph Mastroianni, Carpinteria, all of Calif.

[73] Assignee: Gen-Fold Corporation, Santa Barbara, Calif.

[ * ] Notice: The portion of the term of this patent subsequent to Nov. 1, 2005 has been disclaimed.

[21] Appl. No.: 264,599

[22] Filed: Oct. 31, 1988

Related U.S. Application Data

[63] Continuation-in-part of Ser. No. 38,848, Apr. 15, 1987, Pat. No. 4,780,929.

[51] Int. Cl.[5] ..... E05D 11/10

[52] U.S. Cl. ..... 16/323; 16/324; 16/343; 16/349; 16/359; 16/369; 16/379; 16/387

[58] Field of Search ..... 16/231, 288, 291, 292, 16/294, 297, 302, 321, 343, 349, 352, 358, 359, 360, 361, 368, 369, 370, 371, 375, 378, 379, 384, 387; 280/603

[56] References Cited

U.S. PATENT DOCUMENTS

| | | | |
|---|---|---|---|
| 1,282,435 | 10/1918 | Korb . | |
| 1,302,178 | 4/1919 | Korb . | |
| 1,567,359 | 12/1925 | De Wick . | |
| 1,747,650 | 2/1930 | Sawyer . | |
| 1,810,508 | 6/1931 | Walter . | |
| 2,018,909 | 10/1935 | Anderson . | |
| 2,021,702 | 11/1935 | Soss . | |
| 2,367,528 | 1/1945 | Rollins . | |
| 2,590,991 | 4/1952 | McDonald . | |
| 3,209,390 | 10/1965 | Bassan | 16/358 |
| 3,611,474 | 10/1971 | Meyer | 16/358 |
| 3,834,266 | 9/1974 | Robinson . | |
| 3,881,221 | 5/1975 | Schmidt . | |
| 4,286,353 | 9/1981 | Roache . | |

FOREIGN PATENT DOCUMENTS

| | | | |
|---|---|---|---|
| 1107015 | 8/1981 | Canada | 16/302 |
| 1055399 | 4/1959 | Fed. Rep. of Germany | 16/358 |
| 1548093 | 11/1968 | France . | |
| 2429471 | 6/1978 | France . | |
| 553359 | 4/1958 | Italy | 16/358 |
| 78879 | 7/1951 | Norway . | |
| 513792 | 11/1939 | United Kingdom . | |
| 1048526 | 11/1966 | United Kingdom . | |

*Primary Examiner*—Richard K. Seidel
*Assistant Examiner*—Edward A. Brown
*Attorney, Agent, or Firm*—Amster, Rothstein & Ebenstein

[57] ABSTRACT

A hinged structure comprises a forward body and a rear body each having a surface face and a channel. A first hinge link and a second hinge link are employed to pivotably and slideably connect the forward body and the rear body and to provide movement of the bodies between an open position and a closed position. The first hinge link has a fixed end pivotably affixed to the forward body and a sliding end pivotably and slideably affixed to the rear body. The second hinge link has a fixed end pivotably affixed to the rear body and a sliding end pivotably and slideably affixed to the forward body. The sliding ends of the hinge links are pivotably and slideably affixed to their respective bodies by a pin engaging a hinge slide fitted within the channel of the respective body. Means can be used to secure the rear body to the forward body when the hinge is in the closed position. The hinge structure is integrated into a standard ski construction by mechanically fastening a shear plate to the forward and rear bodies, and integrally laminating the shear plates to the ski.

39 Claims, 7 Drawing Sheets

FIG. 4.
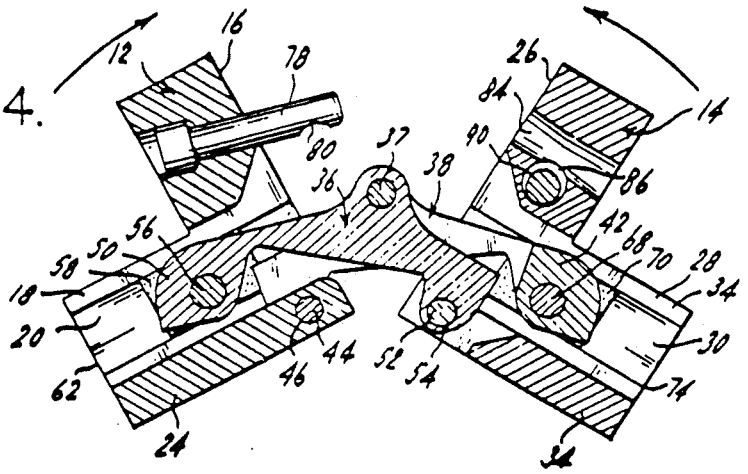
FIG. 5.
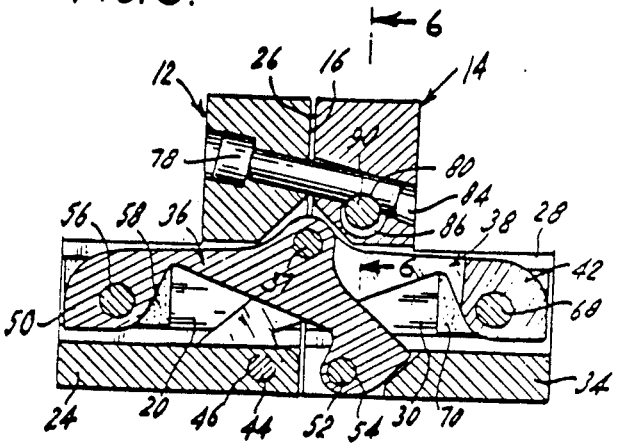
FIG. 7.
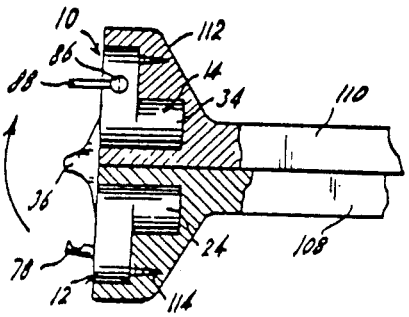
FIG. 8.
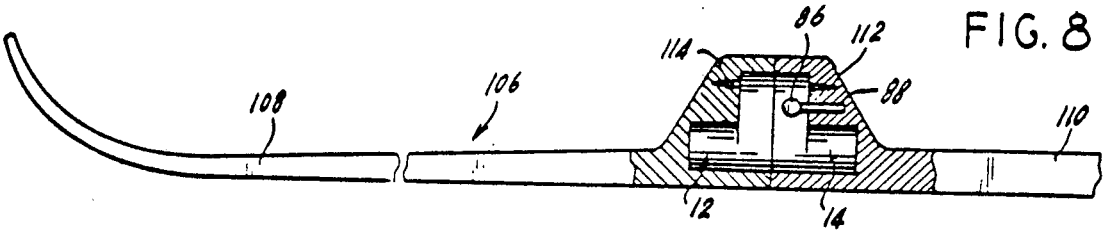
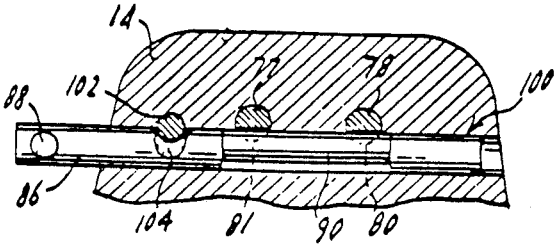
FIG. 6.

HINGED STRUCTURE AND METHOD OF INTEGRATION IN A STANDARD SKI CONSTRUCTION

CROSS-REFERENCE TO RELATED APPLICATIONS

This is a continuation-in-part of application Ser. No. 038,848 filed Apr. 15, 1987, now U.S. Pat. No. 4,780,929.

BACKGROUND OF THE INVENTION

This invention relates generally to a hinged structure and more particularly to a hinged structure and method of integration with a variety of items, such as skis or a guitar, to make them collapsible for easy storage and transportation.

Items such as guitars and skis, by nature, tend to be long and bulky. When a guitar is not in use it is usually placed in an even longer and bulkier case which requires a large amount of storage space and makes transportation, thereof, a cumbersome task. Similarly, when a pair of skis is not in use, its long length makes it difficult to carry and a large space is needed to store it. Typically when skis are transported, they are secured to a ski rack which is placed on the top of an automobile. These methods of carrying, transporting and storing items such as skis and guitars are disadvantageous. They add to the cost of the item, require large amounts of storage space and require a fair amount of skill to carry and transport.

An item is typically manufactured as one piece, such as a ski, is made collapsible by taking that particular item, separating it into component elements and hingeably connecting the same. The resultant structure not only allows the ski to function as a single element when use of such item is desired, but also allows the ski to collapse for easy storage or transportation. Items such as skis, if made collapsible, need to be as strong and rigid as their non collapsible, one-piece counterpart during use and must be able to withstand the stresses and strains to which skis are normally subjected. While various forms of hinged structures, such as guitars, downhill skis and cross-country skis have been heretofore designed, their hinges cannot be adapted for use in a variety of collapsible items. Further, they do not provide enough overall strength and rigidity to allow such items, when in use, to function as if they were manufactured as single units.

U.S. Pat. No. 4,073,211, Fr. Patent No. 2,429,471, and Norway Patent No. 78,879 relate to foldable stringed musical instruments. The hinges employed in these patents are of relatively simple design and do not possess the requisite strength and rigidity that would enable them to be used in combination with high stress related items such as skis. Further, these hinges do not employ locking means to secure the stringed instrument when in use.

U.S. Pat. Nos. 4,262,924, 4,125,273, and 2,367,528 relate to hinged skis. The hinge means employed are manufactured specifically for use in skis and could not be easily adapted for use in any other item, such as a collapsible guitar.

U.S. Pat. Nos. 3,881,221, 2,021,702, 1,810,508, 1,302,178 and 1,282,435 relate to hinges designed particularly for use in connection with doors, extension tables and other conventional applications. These hinges are designed primarily for imparting movement. They do not, for example, provide means to secure the hinged structure when in a closed position.

Accordingly, it is an object of the present invention to provide a hinged structure which can be adapted for use in combination with a variety of collapsible items.

Another object of the present invention is to provide a strong and compact hinged structure which, when used in combination with a collapsible item, is able to equally withstand the stresses of its non collapsible counterpart when such item is in use.

Still another object of the present invention is to provide a hinged structure which is simple in construction and manufacture.

A further object of the present invention is to provide a hinged structure that can be locked when engaged in a closed position.

SUMMARY OF THE INVENTION

It has now been found that the above and related objects of the present invention are attained in a hinged structure comprising a forward body, a rear body, a first hinge link and a second hinge link. Each of the bodies has a surface face, and a channel formed therein extending normal to the surface face. The first hinge link has a fixed end pivotably affixed to the forward body and a sliding end pivotably and slideably affixed to the rear body. The second hinge link has a fixed end pivotably affixed to the rear body and a sliding end pivotably and slideably affixed to the forward body. The first hinge link and the second hinge link are pivotably affixed to one another at a location between the fixed ends and the sliding ends. The sliding ends of each of the hinge links are pivotably and slideably affixed to their respective body by a pin engaging a hinge slide fitted within the channel of the respective body. A locking means is used for locking the rear body and the forward body in a closed position. In a preferred embodiment, the channels extend a distance substantially equal to the lengths of the forward and rear bodies. Preferably the sliding ends of each of the links is pivotably and slideably affixed to their respective body by a pin engaging an eccentrically fixed orifice of a hinge slide fitted within the channel of the respective body.

In a preferred embodiment, the locking means comprises a notched locking pin, affixed to and transversely projecting from the rear body, a corresponding bore located in the forward body for accepting the locking pin when the rear body and the forward body are engaged in the closed position. A rotatable shaft is rotatably secured to the forward body and has an eccentric portion rotatable between a locked position and an unlocked position. The eccentric portion is aligned proximate to the corresponding bore and engages the notch of the locking pin when the forward body and the rear body are engaged in the closed position, and when the tubular shaft is rotated to the locked position. Preferably, a 180° constraint for restricting rotation of the rotatable shaft between the locked position and the unlocked position.

In an alternative embodiment of the locking means, the locking means includes an over-center latch to clamp the forward and rear bodies together. Preferably, the over-center latch includes a first lock link and a second lock link. The first lock link is pivotably attached to the rear member at a first pivot. The second lock link is pivotably attached to the forward member at a second pivot. The first lock link and the second lock link are pivotably attached to each other at a third pivot. The distance between the first and third pivots are less than the combined distance between the first and second pivots and the second and third pivots so that the forward and rear hinge bodies are in compression when the third pivot is swung towards a centerline formed through the first and second pivots. Preferably, to lock the hinge in the closed position, the third pivot passes the centerline and engaqes a stop means. In a preferred embodiment, the stop means includes a portion of the forward body.

In an alternative embodiment, the hinged structure is comprised of a forward body and a rear body moveable with respect to each other between an open and closed position. Each body has a surface face and a channel. The channels extend normal to the surface faces. A first pair of hinge links and a second pair of hinge links are pivotably affixed to one another by a common axis for pivotably and slideably connecting the forward and rear bodies. Each of the hinge links has a fixed end and a sliding end. The first pair of hinge links has their fixed ends pivotably affixed to the rear body and the second pair of hinge links have their fixed ends pivotably affixed to the forward body. A first slide means is employed for pivoting and sliding the sliding ends of the first pair of hinge links within the channel of the forward body. A second slide means is employed for pivoting and sliding the sliding ends of the second pair of hinge links within the channel of the rear body when the forward and rear bodies are moved with respect to each other. A locking means locks the forward and rear bodies in the closed position. Preferably the locking means includes the aforementioned over-center latch to clamp and lock the forward and rear bodies together. Preferably the channels extend a distance substantially equal to the lengths of the forward and rear bodies.

In a preferred embodiment, the fixed ends of the hinge links are pivotably connected to the forward and rear bodies by a body pin; the sliding ends of the hinge links are pivotably and slideably connected to the forward and rear bodies by a slide pin and, the hinge links are pivotably connected to each other by a common pin.

Preferably a first angle formed between a line defined by the common pin and the body pin, and a line defined by the body pin and the slide pin is approximately 61°; a second angle formed between a line defined by the body pin and the slide pin, and a line defined by the slide pin and the common pin is approximately 38°; and, a third angle formed between a line defined by the slide pin and the common pin, and a line defined by the common pin and the body pin is approximately 82°. In a preferred embodiment, the first angle is 60.61694°; the second angle is 37.59805°; and the third angle is 81.78501°.

Preferably the slide means includes a hinge slide pivotably and slideably affixed to the sliding ends of a pair of hinge links by a slide pin. Further, it is preferred that one sliding end of the pair of hinge links is positioned within a groove formed in the hinge slide; and the other sliding end of the pair of hinge links be positioned adjacent to the hinge slide. Preferably the hinge slide is of a polypropylene material.

In a preferred embodiment, the first slide means includes a damping means to put a load on the hinge when engaged in the closed position. Preferrably the damping mean includes a slide damper fitted within the channel of the forward body. Preferably the slide damper is of a polypropylene material.

A method of integrating the hinge structure into a standard ski construction comprises the steps of fastening a first shear plate to a forward body of a hinge; and laminating the first shear plate to a first portion of a ski. Preferably this method further comprises fastening a second shear plate to a rear body of a hinge; and, laminating the second shear plate to a second portion of the ski.

Preferably this method further comprises the steps of fastening the shear plates to the forward and rear bodies by engaging an opening in the shear plates with lugs integrally formed in the forward and rear bodies; and, riveting the shear plates to the forward and rear bodies.

In a preferred embodiment, a method of integrating a hinge into a standard ski construction comprises the steps of surrounding a core of a first portion of a ski with a mat layer; surrounding the mat layer with a uni-directional layer; fastening a shear plate to a forward body of a hinge; fastening the shear plate to the portion of the ski; surrounding the shear plate with a second mat layer; and surrounding the second mat layer with a surface wrap. Preferably the method further comprises the step of laminating the shear plate to the first portion of the ski.

In a preferred embodiment, this method further comprises the steps of surrounding a core of a second portion of a ski with a mat layer; surrounding the mat layer with a uni-directional layer; fastening a second shear plate to a rear body of a hinge; fastening the second shear plate to the second portion of the ski; surrounding the second shear plate with a second mat layer; and surrounding the second mat layer with a surface wrap. Preferably this method further comprises the step of laminating the second shear plate to the second portion of the ski.

BRIEF DESCRIPTION OF THE DRAWINGS

The above brief description, as well as further objects and features of the present invention, will be more fully understood by reference to the following detailed description of the presently preferred, albeit illustrative, embodiments of the present invention when taken in conjunction with the accompanying drawing wherein similar reference characters denote similar elements throughout the several figures:

FIG. 4 is the sectional side elevation view of FIG. 3 showing the hinged structure in transition between the open position and a closed position;

FIG. 5 is the sectional side elevation view of FIG. 3 showing the hinged structure in the closed and locked position;

FIG. 6 is a fragmentary sectional front elevational view of the hinged structure of FIG. 5 taken along the line 6—6 of FIG. 5;

FIG. 7 is a sectional side elevation view of the ski of FIG. 7 employing the hinged structure in the open position;

FIG. 8 is a sectional side elevation view of a ski employing the hinged structure of the present invention in the closed and locked position;

DETAILED DESCRIPTION OF THE PREFERRED EMBODIMENTS

Figure 1:
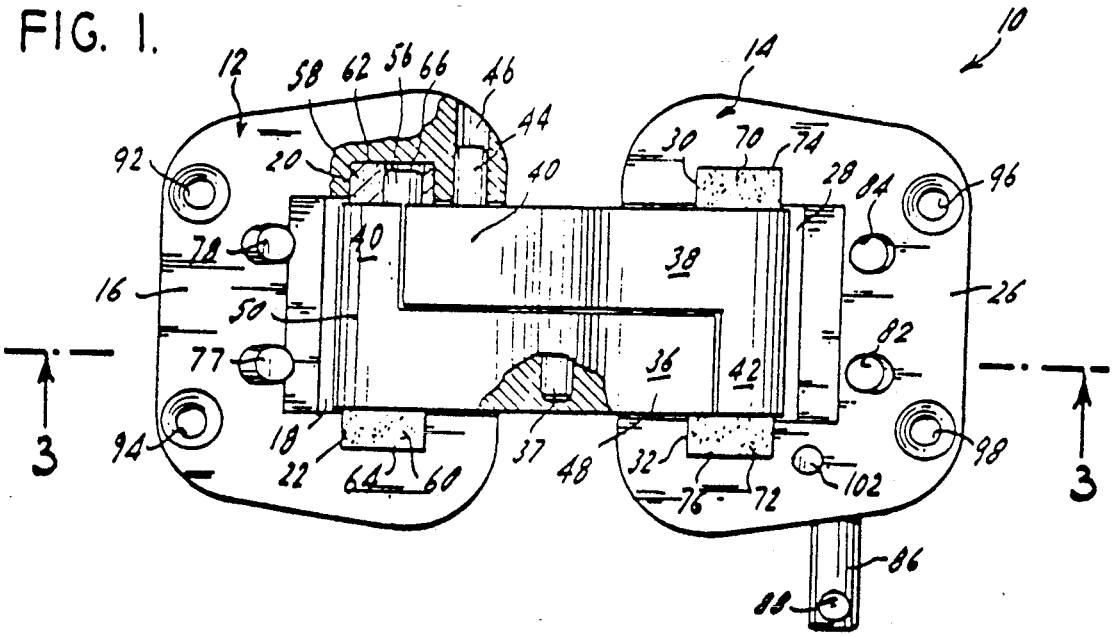
FIG. 1 is a top plan view of the hinged structure of the present invention in an open position.
Figure 2:
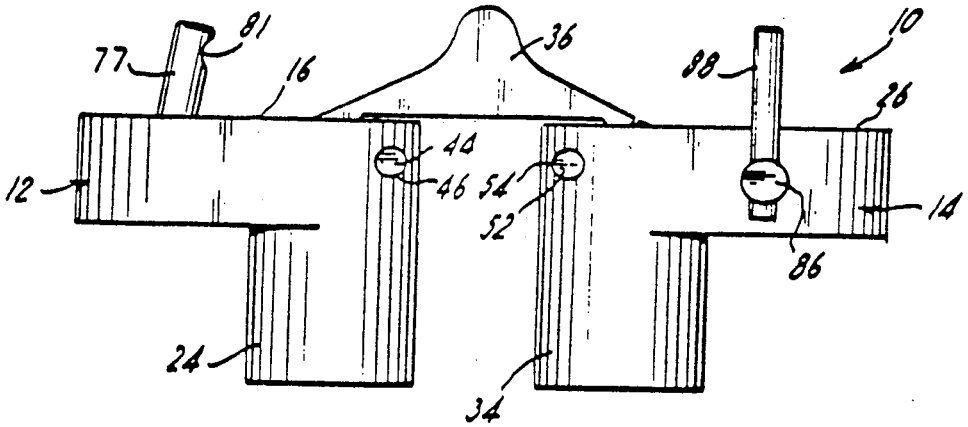
FIG. 2 is a side elevation view of the hinged structure of FIG. 1.

Referring now to FIGS. 1-6, a hinged structure incorporating one embodiment of the present invention is identified generally by the reference numeral 10. The hinged structure 10 is comprised of an upper member or forward body 12 and a lower member or rear body 14. The upper member 12 includes a surface face 16 and a channel 18 including a pair of guideways 20 and 22 located at the distal end of the channel 18 The channel 18 extends normal to the surface face 16 for a distance substantially equal to the length 24 of the upper member 12. Similarly, the lower member 14 includes a surface face 26 and a channel 28 including a pair of guideways 30 and 32 located at the distal ends of the channel 28. The channel 28 extends normal to the surface face 26 for a distance substantially equal to the length 34 of the lower member 14.

The members 12, 14 are pivotably or hingeably connected by a first arm or hinge link 36 and a second arm or hinge link 38. The first arm 36 and the second arm 38 are pivotably affixed to one another by a pin 37. The second arm 38 includes a fixed end 40 and a sliding end 42. The fixed end 40 is pivotably affixed to the upper member 12 by a pin 44, which enters the upper member 12 through a channel 46 and engages the fixed end 40. Similarly, the first arm 36 includes a fixed end 48 and a sliding end 50. The fixed end 48 is pivotably affixed to the lower member 14 by a pin 52, which enters the lower member 14 through a channel 54 and engages the fixed end 48.

The sliding end 50 of the first arm 36 is hingeably and slideably affixed to the upper member 12 by a pin 56 and a pair of floating hinge slides 58, 60. Each of the floating hinge slides 58, 60 have a width corresponding to the widths 62, 64 of the guideways 20, 22 respectively. The pin 56 engages the sliding end 50 and the floating hinge slides 58, 60 which are fitted within the guideways 20, 22. Each of the floating hinge slides 58, 60 has an eccentrically fixed orifice, for example orifice 66 of floating hinge slide 58, so that the pin 56 is eccentrically located in relation to the widths of the guideways 20, 22.

Similarly, the sliding end 42 of the second arm 38 is pivotably and slideably affixed to the lower member 14 by a pair of floating hinge slides 70, 72. Each of the floating hinge slides have a width corresponding to the widths 74, 76 of guideways 30, 32 respectively. The pin 68 engages the sliding end 42 and the floating hinge slides 70, 72 which are fitted within guideways 30, 32. Each of the floating hinge slides 70, 72 has an eccentrically fixed orifice so that the pin 68 is eccentrically located in relation to the widths of the guideways 30, 32.

The upper hinge 12 is formed with a pair of locking pins 77, 78 each including a notch formed at the pin ends. FIGS. 2-5 depict the locking pin 77 with a notch 81. The lower member 14 is formed with a pair of bores 82, 84 for accepting the locking pins 77, 78 when the upper member 12 and lower the member 14 are engaged in the closed position as shown in FIG. 5. The lower member 14 includes a rotatable shaft 86 and a perpendicularly fitted dowel 88. The rotatable shaft 86 includes an eccentric portion 90 which is lined proximate to the bores 82, 84 to form an embedded cam lock. This serves to secure the upper member 12 and the lower member 14 when they are engaged in the closed position as shown in FIG. 5. The upper member 12 and the the lower member 14 are formed with openings 92, 94, 96, 98 which are used to secure the members 12, 14 to two relatively movable parts by conventional means, such as by the use of screws.

Figure 3:
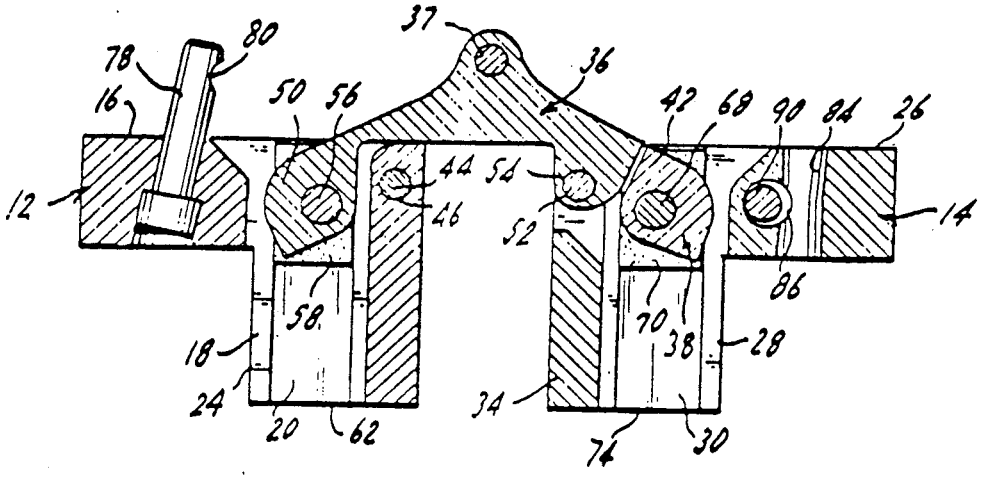
FIG. 3 is a sectional side elevation view of the hinged structure of FIG. 1 taken along the line 3—3 of FIG. 1.

As shown in FIG. 4, when the upper member 12 and the lower member 14 are moved between the open position, as shown in FIG. 3, and the closed position, as shown in FIG. 5, the floating hinge slides 58, 70 slide within guideways 20, 30 while pivotably supporting sliding ends 50, 42. The first arm 36 is pivotably fixed at the fixed end 48 by the pin 52, and the second arm 38 is pivotably fixed at the fixed end 40 by the pin 44. The first arm 36 and the second arm 38 are pivotably fixed to one another by the pin 37.

Specifically referring to FIG. 5, the floating hinge slides 58, 70 and sliding ends 42, 50 have traveled within the guideways 20, 30 for a distance substantially equal to the lengths 24, 34 of the upper member 12 and the lower member 14, respectively. The pins 56, 58 are eccentrically located with respect to the guideways 20, 30 of channels 18, 28 respectively. This allows the arms 36, 38 to be compactly fitted within the hinge 10 without sacrificing the load bearing strength of the hinge 10.

Referring to FIG. 6, the locking pins 77, 78 are guided by and accepted into bores 82, 84. The eccentric portion 90 of the rotatable shaft 86 is shown to be in locked contact with the notches 80, 81 of the locking pins 78, 77. The rotatable shaft 86 has been rotated with the aid of the dowel 80 until the eccentric portion 90 is in firm contact with notches 80, 81 of the locking pins 78, 77 respectively. The pin 102, in conjunction with notch 104, acts to limit the degree rotation of the rotatable shaft 86. For example, the pin 102 and the notch 104 can be constructed to allow a 180 degree of rotation of the rotatable shaft 86 between the locked position of FIG. 6 and an unlocked position, not shown. In the unlocked position, eccentric portion 90 is not in contact with the notches 80, 81 of locking pins 78, 77 respectively. Although the embedded cam lock 100 is presently shown and described as a means for securing the upper member 12 and the lower member 14 when the hinged structure 10 is engaged in the closed position of FIG. 5, other locking means can be employed that act to secure the upper member 12 and the lower member 14 when the hinge 10 is engaged in the closed position of FIG. 5.

Referring now to FIGS. 7–8, the hinged structure 10 is shown to be embedded in a ski 106 composed of two relatively movable parts 108, 110. The upper member 12 is embedded in the part 108 by a screw 114, and the lower member 14 is embedded in the part 110 by a screw 112. FIG. 7 shows the hinged structure 10 in an open and unlocked position. The ski 106 is engaged in this collapsed position by first unlocking the hinge 10, and then folding the parts 108, 110 until they are substantially parallel to one another. Now, the ski 106 is approximately one-half of its normal length and can be easily stored and transported. FIG. 8 depicts the hinged structure 10 in the closed and locked position which allows the ski 106 to be used for the purpose for which it is intended.

Figure 9:
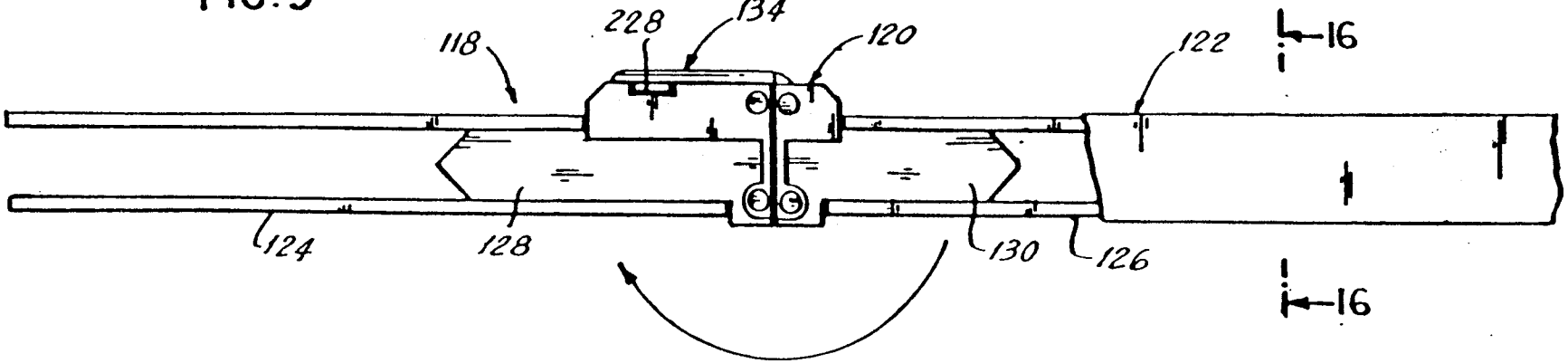
FIG. 9 is a partially broken away side elevation view of an alternative embodiment of the present invention integrated into a ski in a closed and locked position.
Figure 10:
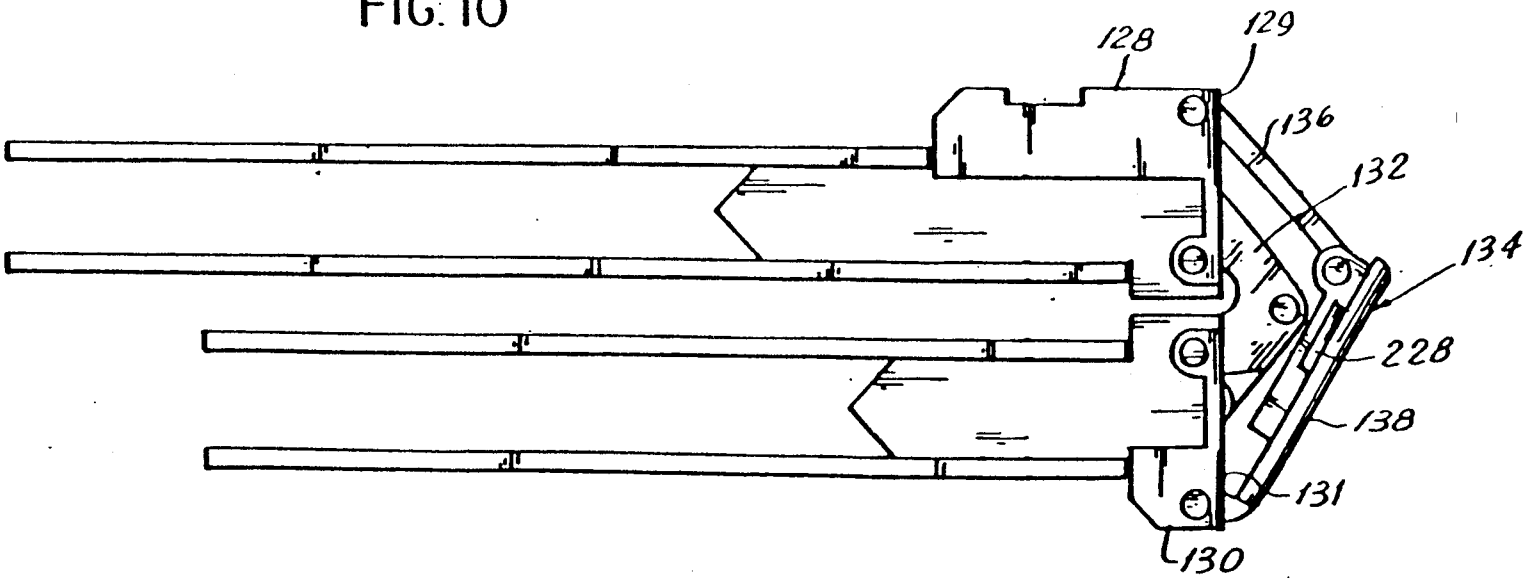
FIG. 10 is a side elevation view of the alternative embodiment of the present invention integrated into a ski in an open position.

Referring now to FIGS. 9, 10, an alternative embodiment of the hinged structure is shown. A hinged structure 118 is comprised of a hinge 120 integrally embedded in a ski 122 composed of two relatively moveable parts 124, 126. Like hinge 10, the hinge 120, as will be explained more fully below, consists of two opposing body sections, a forward body or upper member 128, and a rear body or lower member 130. The forward and rear bodies 128, 130 have surface faces 129, 131 respectively.

The forward and rear bodies 128, 130 are pivotably and slideably connected by a plurality of hinge links, like a hinge link 132, and a plurality hinge slides described below. The locking means for hinge 120 comprises an external latch device 134 to clamp forward and rear bodies 128, 130 together in a closed position, as shown in FIG. 9. The external latch device 134 is an over-center toggle device which comprises a first lock link 136 and a second lock link 138, each pivotably connected to an opposing body section as well as being pivotably connected to each other. The latch 134 specifically being shown and described in connection with the hinge 120, can also be used as a locking means in connection with the hinge 10.

While the second lock link 138 is shown in FIG. 9 to be raised from the forward and rear body portions 128, 130 of the hinge 120, it is recommended that the second lock link 138 be configured to sit flush with the body portions 128, 130 of the hinge 120. This can be done for example, by interfitting the second lock link 138 within the first lock link 136 when the hinged structure 118 is engaged in the closed portion.

Figure 12:
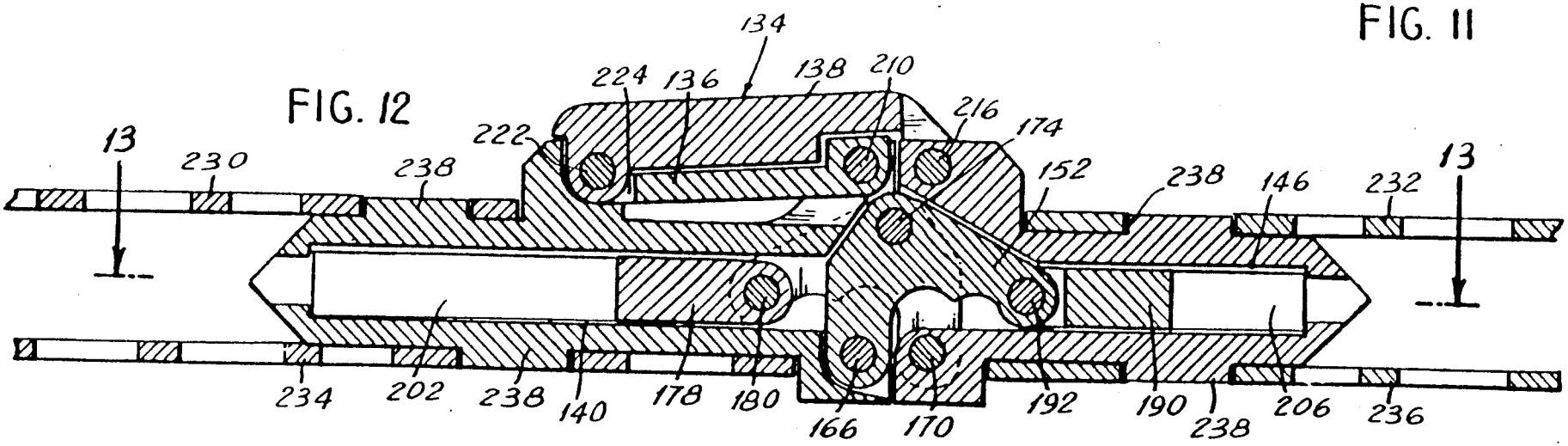
FIG. 12 is an enlarged sectional side elevational view of the hinged structure of FIG. 11 taken along the line 12—12 of FIG. 11.
Figure 13:
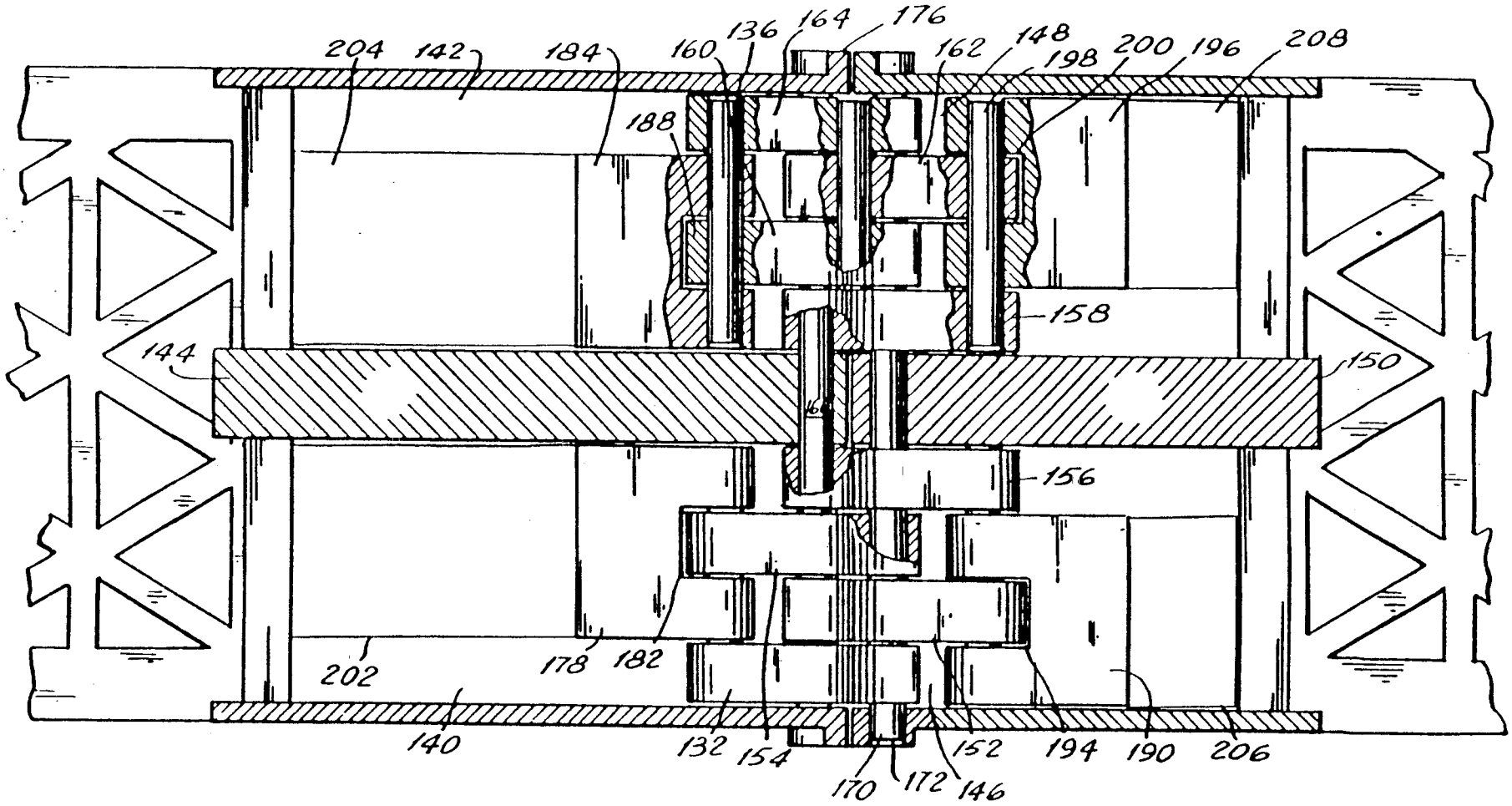
FIG. 13 is a partial sectional plan view of the hinged structure of FIG. 12 taken along the line 13—13 of FIG. 12.

Referring now to FIGS. 12, 13, the forward body 128 includes a first channel 140 and a second channel 142 formed therein, substantially extending throughout the lengths of the forward body 128 normal to the surface face 129. The channels 140, 142 are located On opposite sides of the forward body 128 and separated by a barrier 144. Similarly, the rear body 130 includes a third channel 146 and a fourth channel 148 formed therein, substantially extending throughout the length of the rear body 130 normal to the surface face 131. The channels 146, 148 are located on opposite sides of the rear body 130 and separated by a barrier 150.

The forward body 128 and the rear body 130 are pivotably connected by a plurality of hinge links 132, 152, 154, 156, 158, 160, 162, 164. Each of the hinge links includes a pivotable fixed end and a pivotable sliding end. The pivotable fixed ends of the hinge links 152, 156, 158, 162 interfit with, and are pivotably affixed to, the forward body 128 by a forward body pin 166. Similarly, the pivotable fixed ends of hinge links 132, 154, 160, 164 interfit with, and are pivotably affixed to, the rear body 130 by a rear body pin 170. The hinge links 132, 152, 154, 156 are pivotably connected to each other by a common pin 174; and, the hinge links 158, 160, 162, 164 are pivotably connected to each other by a common pin 176.

The pivotable sliding ends of the hinge links 132, 154 are pivotably and slideably connected to the forward body 128 by engaging a U-shaped hinge slide 178 fitted within the first channel 140. The sliding ends of the hinge links 132, 154 pivotably and slideably engage the hinge slide 178 by a slide pin 180 passing through a bore or cavity formed through the hinge slide 178. The sliding end of the hinge link 132 engages the slide pin 180 adjacent to the hinge slide 178; and, the sliding end of the hinge link 154 engages the slide pin 180 within a channel or groove 182 formed in the U-shaped hinge slide 178.

The pivotable sliding ends of the hinge links 160, 164 are pivotably and slideably connected to the forward body 128 by engaging a U-shaped hinge slide 184 fitted within the second channel 142. The sliding ends of the hinge links 160, 164 pivotably and slideably engage the hinge slide 184 by a slide pin 186 passing through a bore or cavity formed through the hinge slide 184. The sliding end of the hinge link 164 engages the slide pin 186 adjacent to the hinge slide 184; and, the sliding end of the hinge link 160 engages the slide pin 186 within a U-shaped groove 188 formed in the U-shaped hinge slide 184.

The pivotable sliding ends of the hinge links 152, 156 are pivotably and slideably connected to the rear body 130 by engaging a U-shaped hinge slide 190 fitted within the third channel 146. The sliding ends of the hinge links 152, 156 pivotably and slideably engage the hinge slide 190 by a slide pin 192 passing through a bore or cavity formed through the hinge slide 190. The sliding end of the hinge link 156 engages the slide pin 192 adjacent the hinge slide 190; and, the sliding end of the hinge link 152 engages the slide pin 192 within a channel or groove 194 formed in the U-shaped hinge slide 190.

The pivotable sliding ends of the hinge links 158, 162 are pivotably and slideably connected to the rear body 130 by engaging a U-shaped hinge slide 196 fitted within the fourth channel 148. The sliding ends of the hinge links 158. 162 pivotably and slideably engage the hinge slide 196 by a slide pin 198 passing through a bore or cavity formed through the hinge slide 196. The sliding end of the hinge link 158 engages the slide pin 198 adjacent the hinge slide 196; and, the sliding end of the hinge link 162 engages the slide pin 198 within a channel or groove 200 formed in the U-shaped hinge slide 196.

The angles formed between the aforementioned body, common and slide pins as they engage a bore or cavity of each particular hinge link are as follows: The angle formed between a line defined by the common pin and the body pin, and a line defined by the body pin and the slide pin is 60.61694°; the angle formed between a line defined by the body pin and the slide pin, and a line defined by the slide pin and the common pin is 37.59805°; and, the angle formed between a line defined by the slide pin and the common pin, and the line defined by the common pin and the body pin is 81.78501°.

Fitted within the channels 140, 142, 146, 148 are slide dampers 202, 204, 206, 208 respectively. The slide dampers create end walls of the channels 140, 142, 146, 148 for the hinge slides 178, 184, 190, 196 respectively.

The slide dampers 202, 204 are fitted within the back ends of the first and second channels 140, 142 respectively, and are of a width substantially equal to the widths of the hinge slides 178, 184. Similarly, the slide dampers 206, 208 are fitted within the back ends of the third and fourth channels 146, 148 respectively, and are to be of a width substantially equal to the widths of the hinge slides 190, 196.

The slide dampers function as snubbers to put a load on the hinge 120 when it is engaged in the closed position. The slide dampers should be of a sufficient length so that the hinge slides compress the slide dampers when the hinge 120 is engaged in the fully closed position. The slide dampers may be of a polypropylene material, although other materials known to those skilled in the art may be used that suit the aforementioned function.

Referring now to FIG. 12, the latch 134 including lock links 136, 138 is used to clamp the forward and rear body members 128, 130 together in the closed position. The lock link 136 is pivotably attached to the forward body 128 by interfitting one side of the lock link 136 to the forward body 128 in a tongue and groove relationship. The lock link 136 is then pivotably secured to the forward body 128 by threading a pin 210 through interfitting elements of the lock link 136 and the forward body 128.

The lock link 138 is pivotably attached to the rear body 130 by interfitting one side of the lock link 138 to the rear body 130 in a tongue and groove relationship. The lock link 138 is then pivotably secured to the rear body 130 by threading a pin 216 through interfitting elements of the lock link 138 and the rear body 130.

The remaining ends of lock links 136, 138 are pivotably attached to one another by interfitting these ends in a tongue and groove relationship. The lock links are pivotably secured to one another by threading a pin 222 through interfitting elements of the lock link 136 and the lock link 138.

Figure 17:
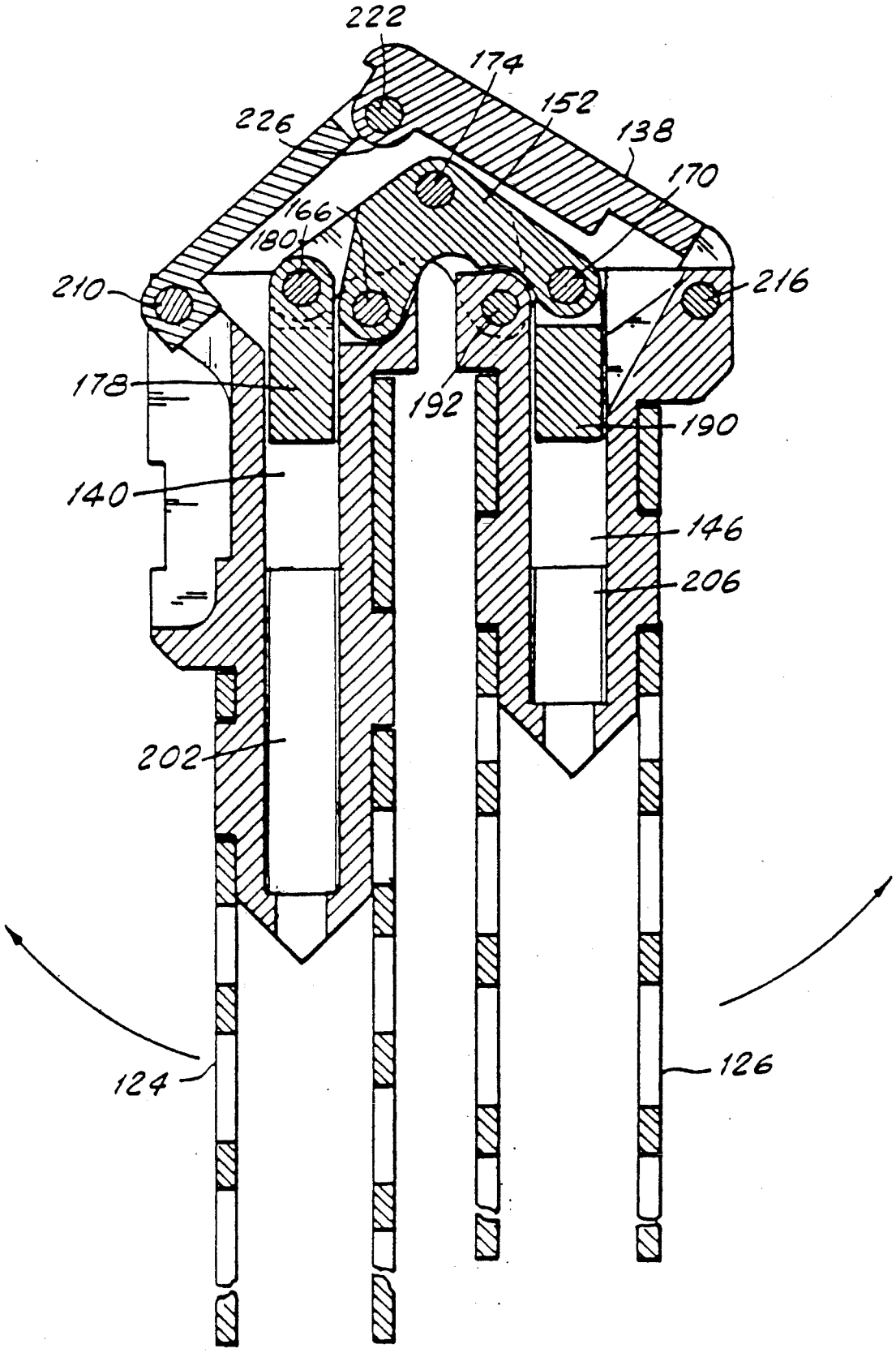

Referring now to FIGS. 10, 17, the hinge 120 is shown in its open state with the ski 122 in a collapsed position, whereby, moveable parts 124, 125 are in substantially parallel orientation. In this position, hinge slides 178, 190 are shown to be positioned in the topmost portion of channels 140, 146 respectively. The slide dampers 202, 206 are oppositely shown to be in the bottom-most portions of channels 140, 146, respectively.

In order to move the hinge 120 to the closed position (or for that matter engaging the ski 122 in an uncollapsed or normal state), moveable parts 124, 126 are extended upward and outward as shown in FIG. 17. In the intermediate stage of FIG. 14, the hinge slides 178, 190 are shown to have partially traveled down the channels 140, 146 towards the slide dampers 202, 206 respectively.

Referring now to FIG. 12, in the closed position the hinge slides have traveled a further distance down the channels to the end walls of the channels created by the slide dampers. In this position, the hinge slides are compressing the slide dampers located within their respective channels. This puts a load on the hinge 120 in this state to ensure that the hinge 120 remains in the closed position.

When the front and rear bodies 128, 130 move with respect to each other, they move about a plurality of pivot points. The fixed ends of the hinge links pivot about the forward body pin 166 and the rear body pin 170 (central pivot axes) which pivotably engage the hinge links to the front and rear bodies 128, 130, respectively. The hinge links pivot about pins 174, 176 with respect to each other. The sliding ends of the hinge links pivot about the slide pins 180, 186, 192, 198. As stated previously, the slide pins engage the sliding ends of the hinge links to the hinge slides which are in turn, fitted within the channels of the front and rear bodies 128, 130.

When the ski 122 is moved from the open or collapsed position, as shown in FIG. 17, towards the closed or uncollapsed position as shown in FIG. 12, the lock links 136, 138 are caused to pivot with respect to the forward and rear bodies 138, 150, and with respect to the lock links 136, 138 themselves. In the closed position, the lock links 136, 138 have been pivoted about so that the lock link 138 now covers the lock link 136. This forms the basis for engaging the hinge 120 in a locked position by closing and locking the latch 134.

Figures 14, 15, 16:
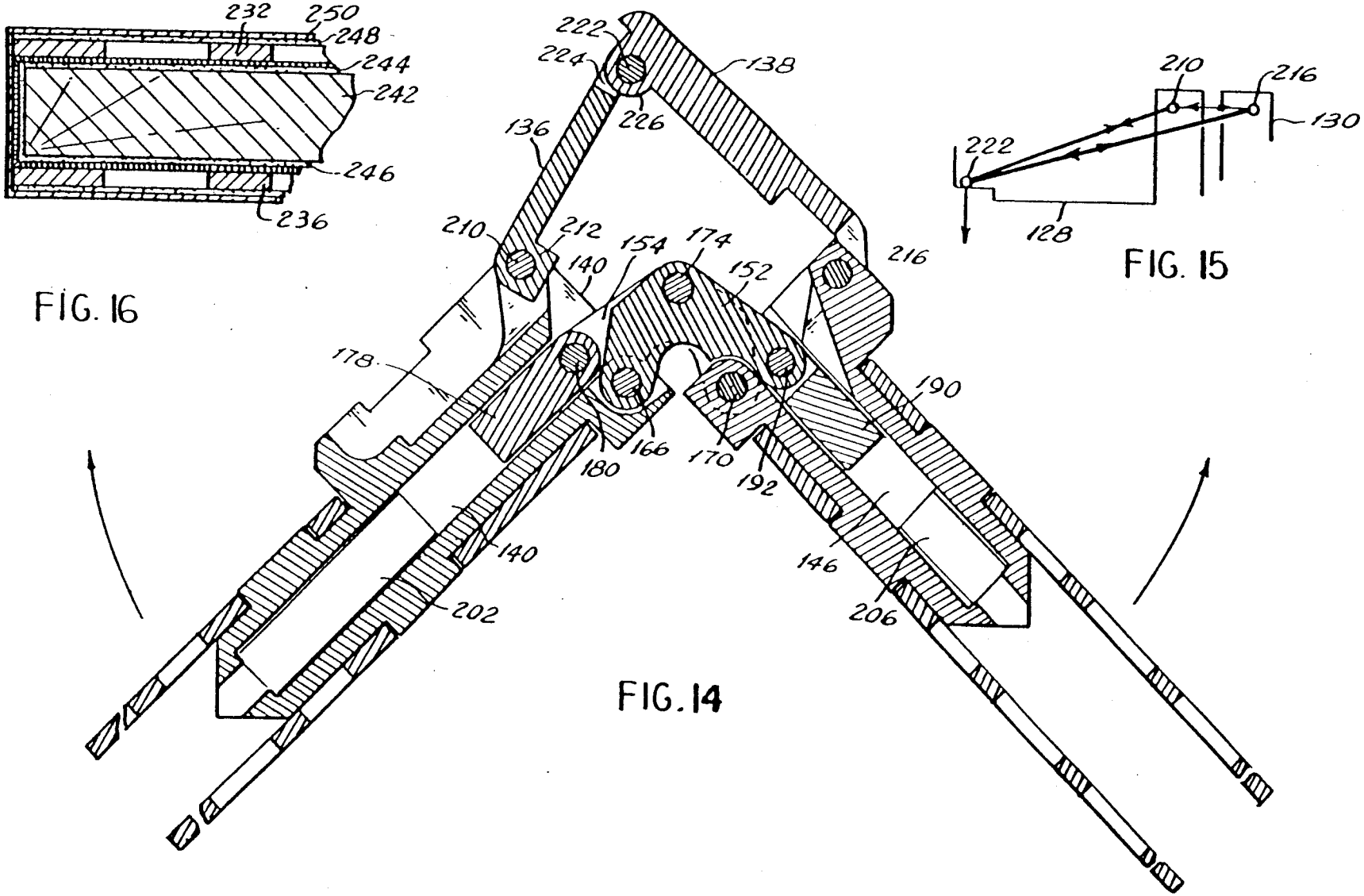
FIG. 14 is the sectional side elevational view of FIG. 12 showing the hinged structure in transition between the open position and the closed position.
FIG. 15 is a vector diagram of the locking means of FIG. 12.
FIG. 16 is a broken away cross-sectional view of the ski of FIG. 9 taken along the line 16—16 of FIG. 9; and, FIG. 17 is the sectional side elevation view of FIG. 12 showing the hinged structure in the open position.

To close the latch 134 and engage the hinge 120 in a locked position, the pin 222 of latch link 138 is swung towards a centerline (not shown) formed through the pins or pivot axes 210, 216. When the pin 222 is swung towards the centerline, the forward and rear hinge bodies 128, 130 are drawn together in a state of compression due to the creation of a clamping force. The clamping force is a result of the lock link 138 (the distance between the pins 216, 222) being slightly shorter than the combined length of the lock link 136 (the distance between the pins 210, 222) and the distance between the pin 216 and the pin 210. This difference in length forces the lock link 138 into tension and the lock link 136 into compression which, in turn, forces the forward body 128 and the rear body 130 together. When the pin 222 passes the centerline towards the face of the forward body 128, which functions as a stop, these forces decrease slightly to cause the latch 134 to remain in the locked position. FIG. 15 is a vector diagram of the latch 134 showing the direction of these forces as they apply to the aforementioned elements.

In order to open the hinge 120, the latch 134 is unlocked by lifting the lock link 138, by grabbing a tab 228 as shown in FIGS. 9, 10. When lifting lock link 138, and moving pin 222 towards the centerline, there is a resultant increase in force that needs to be overcome. This force is overcome as pin 222 passes the centerline. Once the pin 222 passes the centerline, the lock link 138 is then further lifted until the hinge opens.

Figure 11:
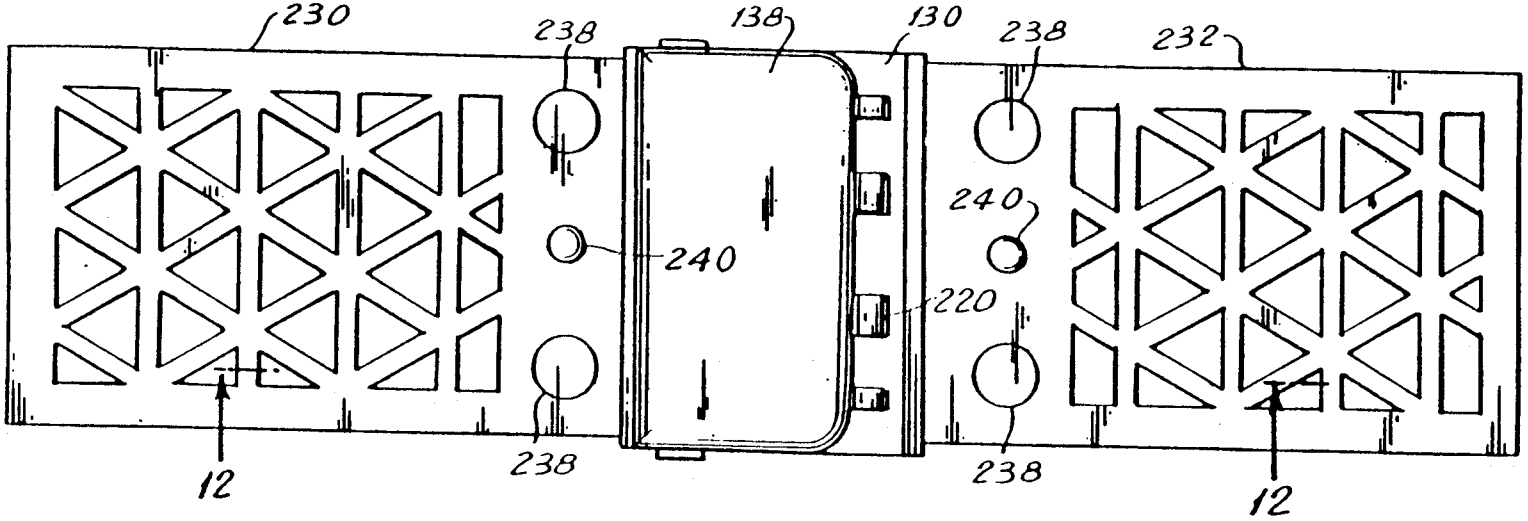
FIG. 11 is a top plan view of the alternate embodiment hinged structure in the closed position.

Referring now to FIGS. 11, 12, 16, the hinge 120 is integrated into a standard ski construction by first mechanically fastening the hinge 120 to shear plates 230, 232, 234, 236. The shear plates are to be 0.04 inches thick. Each shear plate is mechanically fastened to the hinge 120 by two large lugs 238 and a peened rivet 240, although other methods may be used as are known by those skilled in the art. The lugs 238 and the peened rivet 240 form an integral part of the front and rear bodies 128, 130 of the hinge 120.

Once the shear plates have been mechanically fastened to the ski hinge 120, the shear plates ar then integrally laminated into a standard ski construction by any of the known methods. Referring now to FIG. 16, a standard ski construction consists of a core 242, a first mat layer 244, a uni directional layer 246, a second mat layer 248, and then a surface wrap 250. The shear plates are integrally laminated into the ski between the unidirectional layer 246 and the second mat layer 248.

As will be readily apparent to those skilled in the art, the invention may be used in other specific forms or for other purposes without departing from its spirit or central characteristics. The present embodiment is therefore to be considered as illustrative and not restrictive, the scope of the invention being indicated by the claims rather than by the foregoing description, and all embodiments which come within the range of equivalents of the claims are intended to be embraced.

What is claimed is:

1. A hinged structure comprising:

a forward body and a rear body, each said body having a surface face and a channel formed therein, said channels extending substantially normal to said surface faces;

a first hinge link and a second hinge link, said first hinge link having a fixed end pivotably affixed to said forward body and a sliding end pivotably and slideably affixed to said rear body and said second hinge link having a fixed end pivotably affixed to said rear body and a sliding end pivotably and slideably affixed to said forward body, said first hinge link and said second hinge link being pivotably affixed to one another at a location between said fixed ends and said sliding ends, and said sliding ends of each of said hinge links being pivotably and slideably affixed to their respective body by engaging a hinge slide fitted within said channel of their said respective body; and locking means for locking said rear body and said forward body in a closed position.

2. The hinged structure as claimed in claim 1, wherein said locking means comprises:

a notched locking pin, affixed to and transversely projecting from said rear body, a corresponding bore located in said forward body for accepting said locking pin when said rear body and said forward body are engaged in said closed position, a rotatable shaft rotatably secured to said forward body having an eccentric portion rotatable between a locked position and an unlocked position, said eccentric portion aligned proximate to said corresponding bore and engaging said notch of said locking pin when said forward body and said rear body are engaged in said closed position and when said tubular shaft is rotated to said locked position.

3. The hinged structure as claimed in claim 2, wherein said locking means further comprises:

a 180° constraint for restricting rotation of said rotatable shaft between said locked position and said unlocked position.

4. The hinged structure of claim 1 wherein said locking means includes an over-center latch to clamp said forward and rear bodies together.

5. The hinged structure of claim 4 wherein said over-center latch includes a first lock link and a second lock link, said first lock link being pivotably attached to said rear member at a first pivot, said second lock link being pivotably attached to said forward member at a second pivot, and said first lock link and said second lock link being pivotably attached to each other at a third pivot with the distance between said first and third pivots being less than the combined distance between said first and second pivots and said second and third pivots so that said forward and rear hinge bodies are in compression when said third pivot is swung towards a centerline formed through said first and second pivots.

6. The hinged structure of claim 5 wherein said latch locks said hinge in the closed position when said third pivot passes the centerline and engages a stop means.

7. The hinged structure of claim 6 wherein said stop means includes a portion of said forward body.

8. The hinged structure of claim 1 wherein said channels extend a distance substantially equal to the lengths of said forward and rear bodies.

9. The hinged structure of claim 2 wherein said hinged structure is a ski.

10. The hinged structure of claim 2 wherein said hinged structure is a guitar.

11. A hinged structure comprising:

a forward body and rear body, each of said bodies having a surface face and a channel formed therein, said channels extending substantially normal to said surface faces;

a first hinge link and a second hinge link, said first hinge link having a fixed end pivotally affixed to said forward body and a sliding end pivotally and slideably affixed to said rear body and said second hinge link having a fixed end pivotally affixed to said rear body and a sliding end pivotally and slideably affixed to said forward body, said first hinge link and said second hinge link being pivotally affixed to one another at a location between said fixed ends and said sliding ends, and said sliding end of each of said links being pivotably and slideably affixed to their respective body by a pin engaging an eccentrically fixed orifice of a hinge slide fitted within said channel of their said respective body; and, locking means for locking said rear body and said forward body in a closed position.

12. The hinged structure of claim 11 wherein said channels extend a distance substantially equal to the lengths of said forward and rear bodies.

13. A hinged structure comprising:

forward body and a rear body moveable with respect to each other between an open and closed position, each said body having a surface face and a channel formed therein, said channel extending substantially normal to said surface faces;

a first pair of hinge links and a second pair of hinge links pivotably affixed by a common axis for pivotably and slideably connecting said forward and rear bodies, each of said hinge links having a fixed end and a sliding end, said first pair of said hinge links having their fixed ends pivotably affixed to said rear body and said second pair of said hinge links having their fixed ends pivotably affixed to said forward body;

a first slide means for pivoting and sliding said sliding ends of said first pair of hinge links within said channel of said forward body, and a second slide means for pivoting and sliding said sliding ends of said second pair of hinge links within said channel of said rear body when said forward and rear bodies are moved with respect to each other; and, locking means for locking said forward and rear bodies in the closed position.

14. The hinged structure of claim 13 wherein said channels extend a distance substantially equal to the lengths of said forward and rear bodies.

15. The hinged structure of claim 13 wherein said fixed ends of said first pair of hinge links are pivotably connected to said rear body by a body pin; said sliding ends of said first pair of hinge links are pivotably and slideably connected to said forward body by a slide pin; and, said first pair of hinge links are pivotably connected to each other by a common pin.

16. The hinged structure of claim 15 wherein a first angle formed between a line defined by said common pin and said body pin, and a line defined by said body pin and said slide pin is approximately 61°; a second angle formed between a line defined by said body pin and said slide pin, and a line defined by said slide pin and said common pin is approximately 38°; and, a third angle formed between a line defined by said slide pin and said common pin, and a line defined by said common pin and said body pin is approximately 82°.

17. The hinged structure of claim 16 wherein said first angle is 60.61694°; said second angle is 37.59805°; and, said third angle is 81.78501°.

18. The hinged structure of claim 13 wherein said fixed ends of said second pair of hinge links are pivotably connected to said forward body by a body pin; said sliding ends of said second pair of hinge links are pivotably and slideably connected to said rear body be a slide pin; and, said second pair of hinge links are pivotably connected to each other by a common pin.

19. The hinged structure of claim 18 wherein a first angle formed between a line defined by said common pin and said body pin, and a line defined by said body pin and said slide pin is approximately 61°; a second angle formed between a line defined by said body pin and said slide pin, and a line defined by said slide pin and said common pin is approximately 38°; and, the third angle formed between a line defined by said slide pin and said common pin, and a line defined by said common pin and said body pin is approximately 82°.

20. The hinged structure of claim 19 wherein said first angle is 60.61694°; said second angle is 37.59805°; and said third angle is 81.78501°.

21. The hinged structure of claim 13 wherein said first slide means includes a hinge slide pivotably and slideably affixed to said sliding ends of said first pair of hinge links by a slide pin.

22. The hinged structure of claim 21 wherein a sliding end of said first pair of hinge links is positioned within a groove formed in said hinge slide.

23. The hinged structure of claim 21 wherein a sliding end of said first pair of hinge links is positioned adjacent said hinge slide.

24. The hinged structure of claim 21 wherein said first slide means includes damping means to put tension on said hinge when engaged in the closed position.

25. The hinged structure of claim 24 wherein said damping means includes a slide damper fitted within said channel of said forward body to put tension on the hinged structure when the hinged structure is engaged in the closed position.

26. The hinged structure of claim 25 wherein said slide damper is of a polypropylene material.

27. The hinged structure of claim 13 wherein said second slide means includes a hinge slide pivotably and slideably affixed to said sliding ends of said second pair of hinge links by a slide pin.

28. The hinged structure of claim 27 wherein a sliding end of said second pair of hinge links is positioned within a groove formed in said hinge slide.

29. The hinged structure of claim 27 wherein a sliding end of said second pair of hinge links is positioned adjacent said hinge slide.

30. The hinged structure of claim 27 wherein said second slide means includes damping means to put a load on the hinged structure hinge when engaged in the closed position.

31. The hinged structure of claim 30 wherein said damping means includes a slide damper fitted within said channel of said rear body to put a load on the hinged structure when engaged in the closed position.

32. The hinged structure of claim- 31 wherein said slide damper is of a polypropylene material.

33. The hinged structure of claim 13 wherein said locking means includes an over-center latch to clamp said forward and rear bodies together.

34. The hinged structure of claim 33 wherein said over-center latch includes a first lock link and a second lock link, said first lock link being pivotably attached to said rear member at a first pivot, said second lock link being pivotably attached to said forward member at a second pivot, an said first lock link and said second lock link being pivotably attached to each other at a third pivot with the distance between said first and third pivots being less than the combined distance between said first and second pivots and said second and third pivots, so that said forward and rear hinge bodies are in compression when said third pivot is swung towards a centerline formed through said first and second pivots.

35. The hinged structure of claim 34 wherein said latch locks said hinge in the closed position when said third pivot passes the centerline and engages a stop means.

36. The hinged structure of claim 35 wherein said stop means includes a portion of said forward body.

37. The hinged structure of claim 13 wherein said hinged structure is a ski.

38. A hinged structure comprising:

a hinge means including a forward body and a rear body moveable with respect to each other between an open and closed position, each said body having a surface face and a channel formed therein, said channels extending substantially normal to said surface faces;

a first pair of hinge links and a second pair of hinge links pivotably affixed by a common axis for pivotably and slideably connecting said forward and rear bodies, each of said hinge links having a fixed end and a sliding end, said first pair of hinge links having their fixed ends pivotally affixed to said rear body and said second pair of said hinge links having their fixed ends pivotably affixed to said forward body;

a first slide means for pivoting and sliding said sliding ends of said first pair of hinge links within said channel of said forward body, and a second slide means for pivoting and sliding said sliding ends of said second pair of hinge links within said channel of said rear body when said forward and rear bodies are moved with respect to each other;

a portion of a ski;

a shear plate fastened to said forward body and integrally fastened to said first portion of the ski; and locking means for locking said forward and rear bodies in the closed position.

39. The hinged structure of claim 38 including a second portion of a ski; and, a second shear plate fastened to said rear body and integrally fastened to said second portion of the ski.

* * * * *